US007816853B2

(12) United States Patent
Freudenberger et al.

(10) Patent No.: US 7,816,853 B2
(45) Date of Patent: Oct. 19, 2010

(54) LASER STIMULATED CATHODE

(75) Inventors: Joerg Freudenberger, Kalchreuth (DE); Sven Fritzler, Erlangen (DE); Manfred Fuchs, Nuremberg (DE); Detlef Mattern, Erlangen (DE); Peter Roehrer, Uttenreuth (DE); Peter Schardt, Hoechstadt A.D. Aisch (DE)

(73) Assignee: Siemens Aktiengesellschaft, Munich (DE)

( * ) Notice: Subject to any disclaimer, the term of this patent is extended or adjusted under 35 U.S.C. 154(b) by 112 days.

(21) Appl. No.: 12/188,353

(22) Filed: Aug. 8, 2008

(65) Prior Publication Data

US 2009/0041195 A1 Feb. 12, 2009

(30) Foreign Application Priority Data

Aug. 10, 2007 (DE) ..... 10 2007 037 848

(51) Int. Cl.
*H01J 1/62* (2006.01)

(52) U.S. Cl. ..... 313/495; 313/491

(58) Field of Classification Search ..... 313/495, 313/309, 336, 351, 491, 633, 346 R
See application file for complete search history.

(56) References Cited

U.S. PATENT DOCUMENTS

| | | | | |
|---|---|---|---|---|
| 4,606,061 | A | 8/1986 | Ramamurti | |
| 6,054,801 | A | 4/2000 | Hunt et al. | |
| 2007/0064872 | A1 | 3/2007 | Freudenberger et al. | |
| 2007/0187712 | A1 * | 8/2007 | Yamada et al. | 257/103 |
| 2007/0274454 | A1 | 11/2007 | Freudenberger et al. | |

FOREIGN PATENT DOCUMENTS

| | | |
|---|---|---|
| WO | WO 9943870 A1 * | 9/1999 |

* cited by examiner

*Primary Examiner*—Vip Patel
(74) *Attorney, Agent, or Firm*—Schiff Hardin LLP

(57) ABSTRACT

A cathode has an emission layer that thermionically emits electrons upon exposure with a laser beam. The material of the emission layer has a product of density (ρ), measured in $$\frac{kg}{m^3},$$

heat capacity ($C_p$), measured in $$\frac{J}{kgK}$$

and heat conductivity (λ), measured in $$\frac{W}{mK}$$

that is, at room temperature, maximally 500,000

$$\frac{J^2}{m^4K^2s}.$$

Such a cathode has an improved thermionic emission of electrons.

10 Claims, 1 Drawing Sheet

LASER STIMULATED CATHODE

BACKGROUND OF THE INVENTION

1. Field of the Invention

The present invention concerns a cathode with an emission layer that thermionically emits electrons given an exposure (stimulation, activation) with a laser beam.

2. Description of the Prior Art

A cathode of the above type is known from DE 10 2005 043 372 A1 as well as from United States Patent Application Publication No. 2007/0064872 A1, for example. The known cathode is a component of an x-ray radiator. The emission layer is formed of a material with a low vapor pressure and a high melting point, such as tungsten. A high voltage with a gradient of up to 20 kV/mm can be applied at a cathode made from tungsten due to the low vapor pressure. Moreover, tungsten exhibits a high reflectivity relative to laser wavelengths, such that a correspondingly high laser power can be injected. Furthermore, tungsten has an optimal heat conductivity ($\lambda$), heat capacity ($C_p$) and density ($\rho$), such that in the ideal case an electron emission occurs only in the laser focal spot on the cathode. Tungsten is also not susceptible to oxidation and/or contaminations that strongly negatively influence the specification of the cathode.

An x-ray radiator having a cathode with an emission layer that is at least partially roughened and/or porous and/or doped and/or exhibits an intermetallic compound or glass-like carbon (glassy carbon) is described in pending U.S. patent application filed on 23 May 2007 with Ser. No. 11/752,585. The materials used for the emission layer have a satisfactory electron emission only in the case of a relatively large focal area of the laser beam, which leads to a correspondingly severe heating of the cathode.

EP 0 147 009 B1 describes cathodes that are produced from semiconductor materials or other non-metallic solid bodies such as, for example, from bialkalis or trialkalis. Furthermore, metals (for example tungsten and tantalum) are cited in EP 0 147 009 B1 as materials for cathodes.

Moreover, an x-ray tube with a photocathode and an anode is known from WO 98/050056 A1. A photomultiplier is arranged between the photocathode and the anode. A lower optical power is thereby required to generate the x-ray radiation.

SUMMARY OF THE INVENTION

An object of the present invention to provide a cathode of the aforementioned type that has an improved thermionic emission of electrons.

The object is achieved according to the invention by a cathode having an emission layer that thermionically emits electrons given an exposure with a laser beam, wherein the material of the emission layer has a product of:

density ($\rho$), measured in kg/m$^3$, heat capacity ($C_p$), measured in J/(kg·K), and heat conductivity ($\lambda$), measured in W/(w·K)

that is, at room temperature, maximally 500,000 J$^2$/(m$^4$·K$^2$·s).

In the following, the product of the physical quantities density ($\rho$), heat capacity ($C_p$) and heat conductivity ($\lambda$) is designated as $\rho C_p\lambda$.

Of the physical quantities that form the $\rho C_p\lambda$ product, heat capacity ($C_p$) is material-dependent and therefore essentially constant, contrary to which the density ($\rho$) and the heat conductivity ($\lambda$) are indirectly proportional to the porosity of the material. The porosity is measured in ppi (pores per inch), for example. The higher the porosity, the higher the number of pores per inch; or, in other words, the grater the ppi value of the material, the smaller the density ($\rho$) and the heat conductivity ($\lambda$) of the appertaining material. A high porosity thus lowers the $\rho C_p\lambda$ product. Micro-porous and nano-porous materials (materials with a microstructure or a nanostructure) have correspondingly high ppi values.

According to a preferred embodiment of the cathode according to the invention, the $\rho C_p\lambda$ product for the material of the emission layer is at maximum 50,000 J$^2$/(m$^4$·K$^2$·s). A material that satisfies this requirement is, for example, micro-porous carbon foam that, for example, possesses a density ($\rho$) of 150 kg/m$^3$, a heat capacity ($C_p$) of 1,200 J/(kg·K) and a heat capacity ($\lambda$) of 0.25 W/(m·K).

A cathode whose emission layer is produced from a material whose $\rho C_p\lambda$ product is at maximum 20,000 J$^2$/(m$^4$·K$^2$·s) is particularly advantageous. A material that has this property is, for example, carbon nano-foam, an aerogel with, for example, a density ($\rho$) of 262 kg/m$^3$, a heat capacity ($C_p$) of 1,200 J/(kg·K) and a heat capacity ($\lambda$) of 0.05 W/(m·K).

In comparison to this, the glassy carbon proposed in the cathode according to the German patent application 10 2006 024 437.0 has a density ($\rho$) of 1.435 kg/m$^3$, a heat capacity ($C_p$) of 1,260 J/(kg·K) and a heat capacity ($\lambda$) of 10.8 W/(m·K). Glassy carbon therefore has a $\rho C_p\lambda$ product of well above 500,000 J$^2$/(m$^4$·K$^2$·s) at room temperature.

Materials with the ppi values of at least 50 ppi (necessary for the low densities ($\rho$)) cannot be produced from metallic compounds without further measures. Micro-porous carbon foams exhibit at least 100 ppi and aerogels distinctly above 100 ppi. The necessary micro-porosity or, respectively, nano-porosity is advantageously achieved via a thermal decomposition of synthetics in carbon compounds (micro-porous carbon foam or, respectively, carbon nano-foam, aerogel).

For the purposes described herein, micro-porous materials as well as nano-porous, carbon-like materials with a density smaller than 1,000 kg/m$^3$ at room temperature have a number of advantages.

Due to the high porosity, which leads to a very high specific surface, micro-porous and nano-porous materials possesses an emissivity of more than 90% and therefore a reflectivity if less than 10%.

Given such a high emissivity, a great amount of laser power can be injected into the material of the emission layer; in other words, the absorption rate of this material is correspondingly high. Due to the micro-porous or, respectively, nano-porous structuring of the porosity, the laser light is "captured" in the emission layer of the cathode, so to speak. This high emissivity (which results from the finely structured porosity) leads to a correspondingly high electron emission that possesses a high quality with regard to its stability and reproducibility.

For a medical application, the material of the emission layer is advantageously selected with regard to its ppi value such that the focal size of the laser beam (laser focal spot) is at least 100 times the ppi value.

According to a preferred embodiment of the cathode according to the invention, the emission layer is not executed planar in the region of the focus of the laser beam, for example, but instead is convexly curved. Splitting of the electron beam is therefore advantageously minimized, and only a small laser power is required.

DESCRIPTION OF THE PREFERRED EMBODIMENTS

Figure 1:
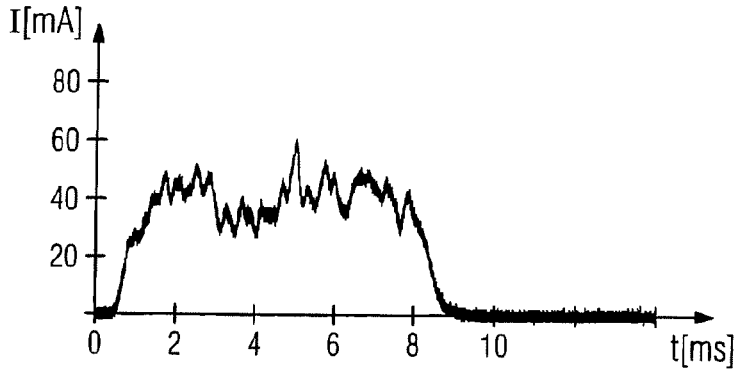
FIG. 1 shows the pulse duration and the pulse curve of the electron emission of a first embodiment of a cathode in accordance with the invention, having an emission layer made from a micro-porous carbon foam.
Figure 2:
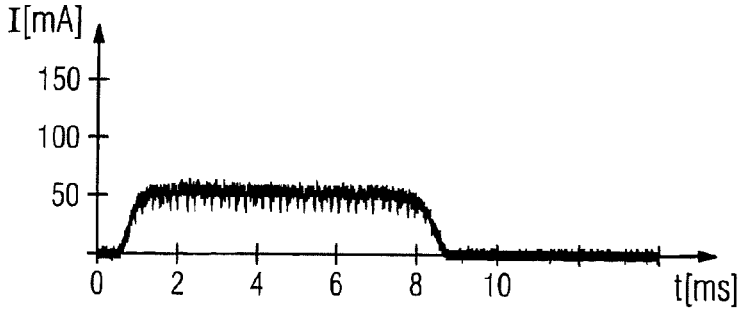
FIG. 2 shows the pulse duration and the pulse curve of the electron emission in a second embodiment of a cathode in accordance with the invention, having an emission layer made from a carbon nano-foam (aerogel).

In FIGS. 1 and 2, the ordinates respectively form the time axis and the current signals are respectively plotted on the abscissa. These current signals are proportional to the number of the electrons thermionically emitted upon exposure with a laser beam.

As can be seen from the distribution of the thermionically emitted electrons presented in FIGS. 1 and 2, the emission distributions of electrons that were generated by a laser beam in a micro-porous carbon foam and the emission distributions of electrons that were generated by a laser beam in a nano-porous carbon foam respectively exhibit a pulse duration of approximately 8 ms and an average current signal strength of 50 mA.

The measured average signal strength of 50 mA and the measured pulse duration of approximately 8 ms show that both micro-porous carbon foam and carbon nano-foam (aerogel) are suitable as materials for emission layers with which a cathode can be achieved that exhibits an improved thermionic emission of electrons relative to the previously known cathodes.

Figure 3:
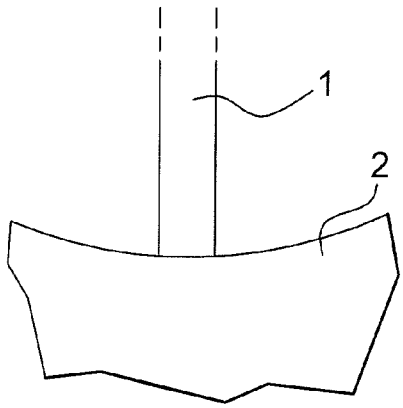
FIG. 3 shows an enlarged view of a preferred embodiment of the surface of the electron emitter in accordance with the present invention.

According to preferred embodiment of the cathode according to the invention shown in FIG. 3, the emission layer 2 is not executed planar in the region of the focus of the laser beam 1, but instead is convexly curved.

Although modifications and changes may be suggested by those skilled in the art, it is the intention of the inventors to embody within the patent warranted hereon all changes and modifications as reasonably and properly come within the scope of their contribution to the art.

We claim as our invention:

1. A cathode comprising an emission layer that thermionically emits electrons by heating of said emission layer by exposure with a laser beam, the emission layer being composed of material that has a density (ρ), measured in $$\frac{kg}{m^3}.$$

a heat capacity ($C_p$), measured in $$\frac{J}{kgK} \text{ and}$$

a heat conductivity (λ), measured in $$\frac{W}{mK}$$

with a product of said density, heat capacity and heat conductivity, at room temperature, being a maximum of 500,000

$$\frac{J^2}{m^4K^2s}.$$

2. A cathode as claimed in claim 1, wherein the product of said density (ρ), said heat capacity ($C_p$) and said heat conductivity (λ) for the material of the emission layer is a maximum of 50,000

$$\frac{J^2}{m^4K^2s}.$$

3. A cathode as claimed in claim 1, wherein the product of density (ρ), heat capacity ($C_p$) and heat conductivity (λ) for the material of the emission layer is a maximum of 20,000

$$\frac{J^2}{m^4K^2s}.$$

4. A cathode as claimed in claim 1, wherein the density (ρ) at room temperature is less than 1,000

$$\frac{kg}{m^3}.$$

5. A cathode as claimed in claim 1, wherein the material of the emission layer consists of a carbon foam.

6. A cathode as claimed in claim 1, wherein the material of the emission layer consists of a microporous carbon foam.

7. A cathode as claimed in claim 1, wherein the material of the emission layer consists of an aerogel.

8. A cathode as claimed in claim 7, wherein the material of the emission layer consists of a carbon nano-foam aerogel.

9. A cathode as claimed in claim 1, wherein the emission layer is exposed to a laser beam having a focal size and the material of the emission layer has pores per inch (ppi) a value selected dependent on a focal size of the laser beam to cause the focal size of the laser beam to be at least 100 times the ppi value.

10. A cathode as claimed in claim 1, wherein the laser beam has a focus size, and wherein the emission layer is convexly curved in the region of the focus of the laser beam.

* * * * *